US009326624B2

(12) United States Patent
Dominguez, Jr.

(10) Patent No.: US 9,326,624 B2
(45) Date of Patent: May 3, 2016

(54) ARTICLE MOUNTING SYSTEM

(71) Applicant: Manuel Dominguez, Jr., Argyle, TX (US)

(72) Inventor: Manuel Dominguez, Jr., Argyle, TX (US)

( * ) Notice: Subject to any disclaimer, the term of this patent is extended or adjusted under 35 U.S.C. 154(b) by 26 days.

(21) Appl. No.: 14/221,218

(22) Filed: Mar. 20, 2014

(65) Prior Publication Data

US 2014/0284438 A1 Sep. 25, 2014

Related U.S. Application Data

(60) Provisional application No. 61/803,545, filed on Mar. 20, 2013.

(51) Int. Cl.

| | |
|---|---|
| ***A44B 1/18*** | (2006.01) |
| ***A47G 1/21*** | (2006.01) |
| ***G09F 1/10*** | (2006.01) |
| ***G09F 15/00*** | (2006.01) |
| ***G09F 7/06*** | (2006.01) |

(52) U.S. Cl.
CPC .. *A47G 1/21* (2013.01); *G09F 1/10* (2013.01); *G09F 7/06* (2013.01); *G09F 15/0018* (2013.01)

(58) Field of Classification Search
CPC ..... A47G 1/16; A47G 1/21; A47G 25/0607; B42F 1/00; B42F 1/02; D06F 55/00; Y10T 24/44017; Y10T 24/44427; Y10T 24/203; G09F 1/10; G09F 7/06; G09F 15/0018
USPC ..... 248/205.2; 211/89, 45
See application file for complete search history.

(56) References Cited

U.S. PATENT DOCUMENTS

| | | | | | |
|---|---|---|---|---|---|
| 2,402,215 | A | * | 6/1946 | Thomas | 269/211 |
| 2,827,719 | A | * | 3/1958 | Nairn | 40/666 |
| 3,593,386 | A | * | 7/1971 | Hug | 24/457 |
| 3,597,813 | A | * | 8/1971 | Takahashi et al. | 24/67.5 |
| 4,291,810 | A | * | 9/1981 | Rubenstein | 211/89.01 |
| D274,127 | S | * | 6/1984 | Einhorn et al. | D8/395 |
| D300,298 | S | * | 3/1989 | Mori | D8/72 |
| 4,840,341 | A | * | 6/1989 | Hasegawa | 248/316.5 |
| D405,808 | S | * | 2/1999 | Bankier | D15/78 |
| 6,131,865 | A | * | 10/2000 | Adams | 248/206.2 |
| 2003/0042218 | A1 | * | 3/2003 | Bell | 211/88.01 |

* cited by examiner

*Primary Examiner* — Korie H Chan
(74) *Attorney, Agent, or Firm* — Jeffrey Roddy

(57) ABSTRACT

An article mounting system for non-destructively mounting sheet articles such as posters and other paper items to a mounting surface such as a wall, includes a clamping plate which is pivotable. A resilient compressible member holds the plate in a normal down position such that a portion of the plate serves as a jaw for pressing the sheet article against the mounting surface. The article is loosed by compressing the resilient member which pivots the plate.

8 Claims, 4 Drawing Sheets

FIG.6
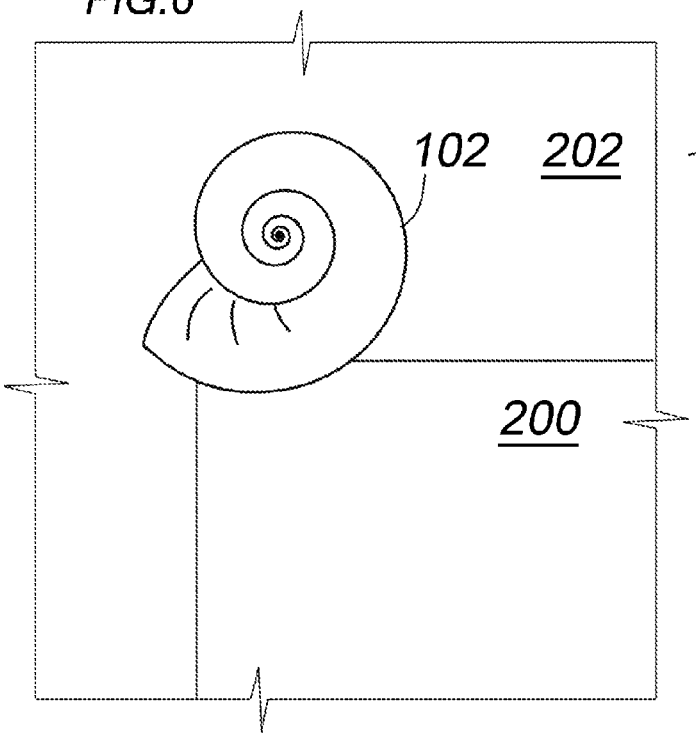
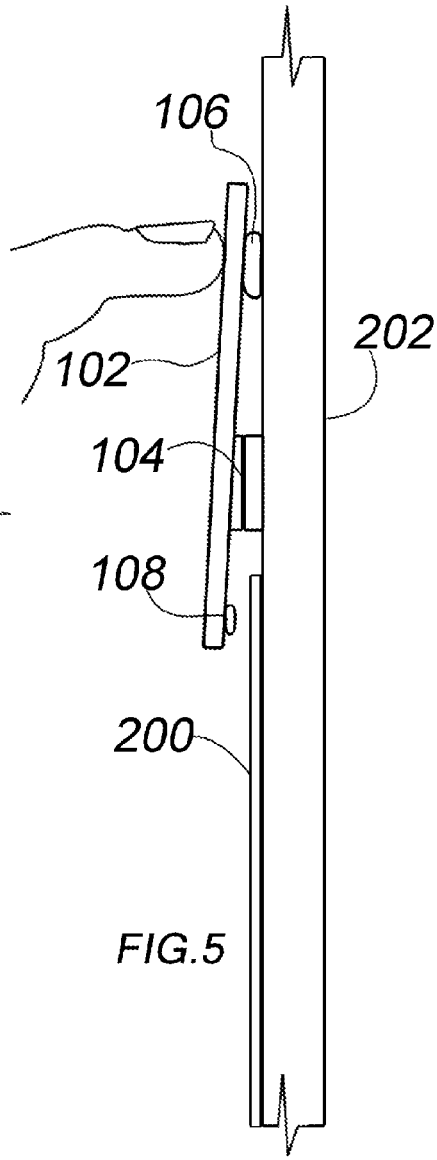
FIG.5
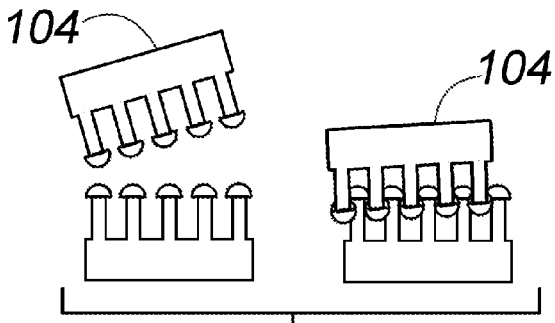
FIG.7

ARTICLE MOUNTING SYSTEM

FIELD OF THE INVENTION

The instant invention relates generally to retainers for paper articles.

RELATED ART

In the past, various approaches and attempts to produce simple paper article retention devices for temporary affixing of the article to a surface have been described. The vast majority depend on a spring, usually a coil, and operate similarly to a clothes pin. Other means to grab the paper article are limited to particular surfaces to which they can be attached. U.S. Pat. No. 1,067,320 to Cunin, describes a spring operated clip adapted to secure articles such as slips of paper to a plate or leaf. U.S. Pat. No. 1,632,856 to Bunning describes a suction cup spring device for holding sheets of paper. More recently, U.S. Pat. No. 6,352,229 to Adams describes a flexible clip for magnetic attachment to a metal surface such as a refrigerator.

Painted and textured walls such as those in a child's room or a dorm room, present challenges for hanging articles such as posters by conventional methods such as using double stick tape, one sided tape, etc., as the foregoing methods can mar a wall's finish and often damage paper articles being secured because they are very sticky and cannot be removed easily, if at all. It would be desirable to provide an means for temporarily mounting paper articles to a surface; especially a vertical surface such as a wall, that is easy to apply, does not harm the surface, clamps and unclamps article(s) to the mounting surface without damage to the articles, and is less complicated in its manufacture than past article holders.

SUMMARY

In an aspect of the present invention a clamp is non-destructively mounted to a wall in order to hold an article, typically a paper article to the wall by retaining the article to a vertical surface such as a wall between a bottom face of the clamp and the wall surface. The clamp includes a pivoting plate that is typically planar on the side facing the article, but otherwise for decorative purposes, can possess any coloring, indicia or suitable outline or outwardly facing shape such as a flower shape, baseball shape, etc. The clamp has a bottom surface that faces the article and includes at least one non-slip element such as an elastomeric nub that presses non-destructively against a retained article, and a mid-section which is attachable to the wall by hook and loop strip fastener pairs wherein one strip of the pair is attached to the plate while the other is attached to a mounting surface. Preferably, hook and look strips with a low tack adhesive can be used. The bottom side of the clamp plate also includes a compressible element such as a piece of closed cell foam of a greater thickness than the overall thickness of the joined hook and loop strip pair.

To attach the clamp to a wall, the position of the clamps is first marked, and one member of a hook and loop pair is attached to the wall. The hook or loop member is then mated with the other member of the hook and loop pair attached to back side of the clamping plate. The hook and loop pair function as a pivot point for the clamping plate while the relatively thicker compressible foam member biases the bottom section of the plate with the gripping element(s) over the retained article and the wall. To release the clamp, finger pressure is applied to the upper section of the plate to compress the foam element.

The compressible element is preferably a piece of closed-cell foam which is attached to the back of a clamping plate. In a closed-cell foam (CCF), the gas forms discrete pockets, each completely surrounded by the solid material. The CCF can be substantially compressed by the fingers and will resume its original shape. In this way, the compressible element leverages the plate in a normal down position against a retained article and the supporting surface (wall). Preferably, resilient polyethylene closed-cell foam is employed, although other resilient foams can be used. Other compressible elements such as various resilient rubber shapes; i.e., hollow elastomeric balls, cubes, tubes and channels can be used to reversibly bias the clamp plate in a down position.

The plate can be any suitably rigid material including foamboard, cardboard, metal, wood, plastic or corrugated sign board. The hook and loop fasteners can be substituted with light tack double sided foam tape, or other material that will reliably adhere the plate to a mounting surface, while providing a flexible bond between the plate and the mounting surface such that the plate can be pivoted. One preferred material for the pivoting member are Dual Lock™ fasteners by 3M™. Other flexible, directly adhering materials will suggest themselves to those having skill in the art and benefit of this disclosure.

The grippers of the plate intended for direct contact with a held article can be one or any number of elastomeric dots or rubber bumpers which are pre-applied to a portion of the plate by gluing, printing or other means. The grippers may be a textured elastomeric coating applied to a portion of the plate applied by printing, spraying or dipping. Preferably, the gripper material is clear or light colored to avoid discoloring or adhering to the retained article. Various rubber elements such as rubber bumpers of silicone or clear and amber urethanes are suitably non-reactive with paper articles. Conceivably, sections of cross-linked polyethylene foam can provide sufficient grip and substitute for the rubberized elements.

The shape of the plate can vary as long as it permits the grippers to contact a held article. Because the unique structure of the present invention permits the use of less material than past clips or clamps, die cut and stamped designs, custom printed logos and colors can be applied to the plate economically without compromising the utility of the present invention. Conceivably, blank plates can be provided to consumers allowing customization in any way desired.

The foregoing and other objects, features, and advantages of the invention will become more apparent from the following detailed description, which proceeds with reference to the accompanying figures.

BRIEF DESCRIPTION OF THE DRAWINGS

FIG. 5 is a side view thereof showing the article of (FIG. 4) being released;

FIG. 6 shows an embodiment according to the present invention with an exemplary decorative aspect;

FIG. 7 is a closed up elevation of two strips of Dual Lock™ fasteners.

DETAILED DESCRIPTION OF THE INVENTION

Figure 1:
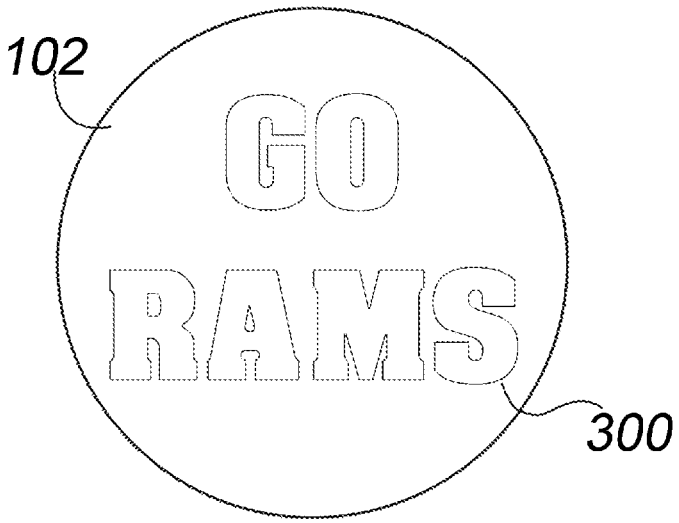
FIG. 1 is a top plan view of one embodiment of the present invention.
Figure 2:
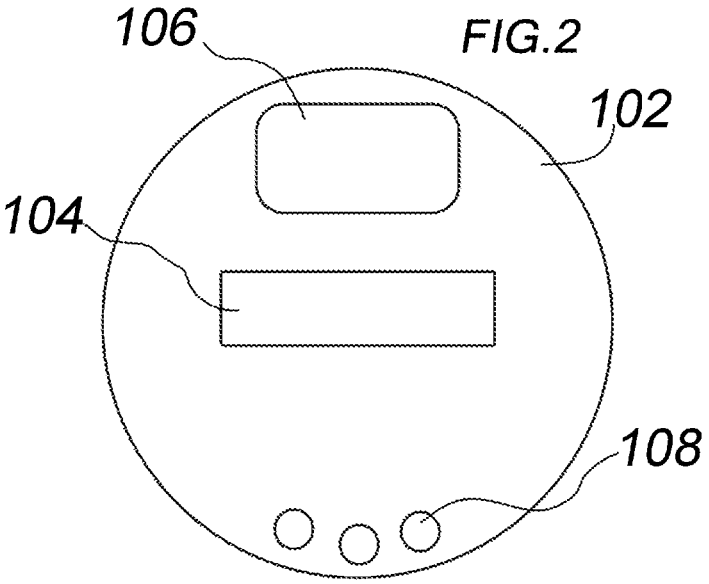
FIG. 2 is a bottom plan view of the embodiment of (FIG. 1)

Reference Listing
100 hold-down
102 body
104 attachment member
106 resilient compressible member
108 gripper(s)
200 mountable article
202 mounting surface
300 decorative element
Definitions In the following description, the term "clamp" refers to a device with a single jaw for clamping an article to a surface. The term "light tack" refers to any adhesive that is attachable to a surface that can be removed from said surface without damage to the surface such as paint removal. Unless otherwise explained, any technical terms used herein have the same meaning as commonly understood by one of ordinary skill in the art to which this disclosure belongs. The singular terms "a," "an," and "the" include plural referents unless the context clearly indicates otherwise. Similarly, the word "or" is intended to include "and" unless the context clearly indicates otherwise. Although methods and materials similar or equivalent to those described herein can be used in the practice or testing of this disclosure, suitable methods and materials are described below. The term "comprises" means "includes." Publications, patent applications, patents, and other references mentioned herein, if any, are incorporated by reference in their entirety for all purposes. In case of conflict, the instant specification, including explanations of terms, will control. In addition, the materials, methods, and examples are illustrative only, and not intended to be limiting.

Referring generally to FIGS. 1-8, a mounting system 100 for mounting sheet articles 200 to a mounting surface 202 includes a clamping plate 102 having a top side which can be colored or printed with any design. The circular shape, shell shape and printed indicia depicted in FIGS. 1-6 are provided as exemplary decorative aspects and intended to be non-limiting. The back side of plate 102 possesses an attachment member 104 that also functions as a flexible fulcrum. Preferably, attachment member 104 is a pair of mating hook and loop fasteners with a first part attached to the back of the plate, and a second part attached directly to the mounting surface. The thickness of the hook and loop pair permits a degree of flexibility such that when the plate is attached to the wall as described, the plate can teeter back and forth in see-saw fashion. The back of the plate also possesses at least one compressible member 106 of preferably a closed-cell resilient foam. A coiled spring 107 attached to the underside of the plate and terminating in a non-marring cap 107*a* for contact with the wall, may be substituted in lieu of the closed-cell foam member (FIG. 4*a*). The plate also possesses one or more gripping members 108 that are flexible and non-marring for applying pressure against a retained article.

Figure 3:
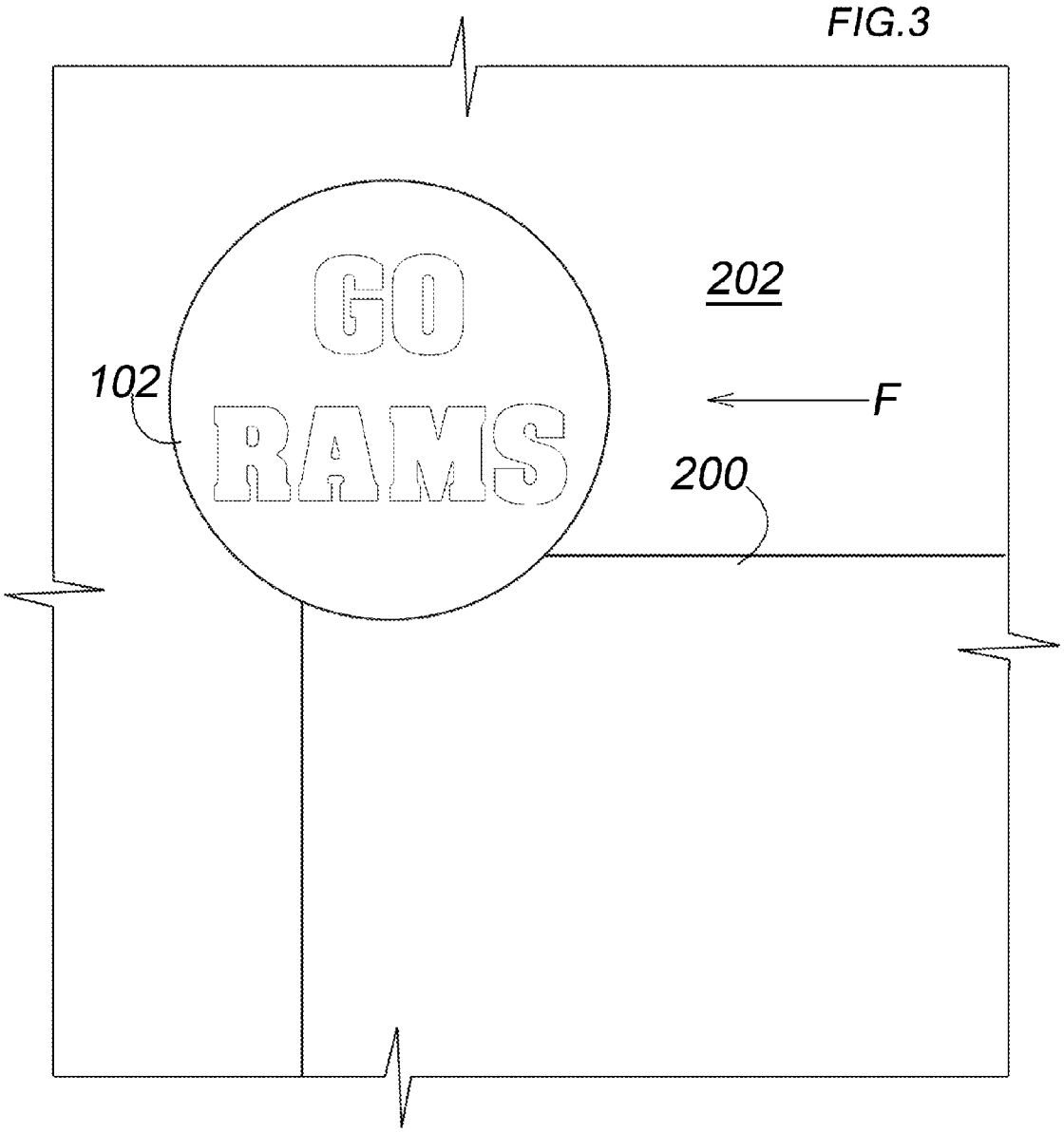
FIG. 3 is a top perspective view showing the embodiment of (FIG. 1) at the corner of a mounted article.

FIG. 3 shows one embodiment at a top right corner of a retained article 200 such as a poster which is clamped to surface 202.

Figure 4:
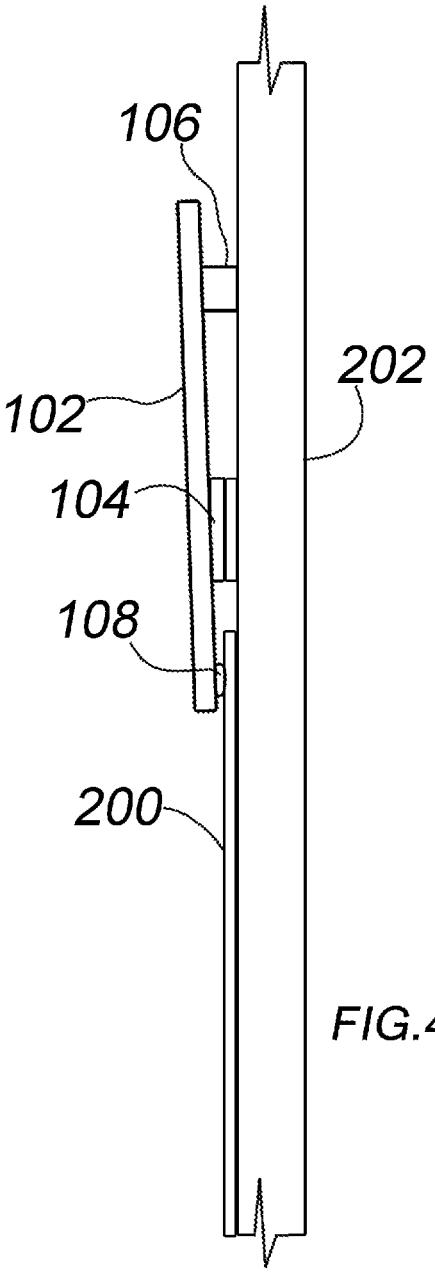
FIG. 4 is a side view thereof taken in the direction indicated by arrow (F) showing one embodiment clamping a sheet article to a wall.
Figure 4A:
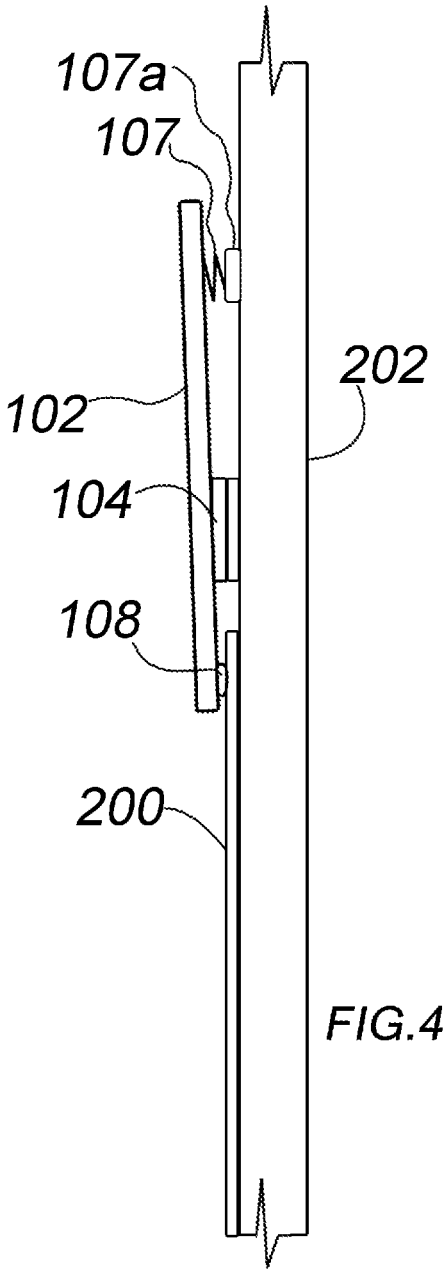
FIG. 4*a* is a side view of another embodiment thereof taken in the direction indicated by arrow (F) showing one embodiment clamping a sheet article to a wall.
Figure 4B:
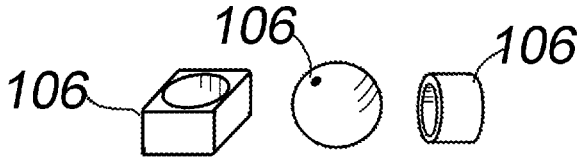
FIG. 4*b* is a grouping of compressible members.

FIG. 4 presents a side view of (FIG. 3) showing clamping plate 102 in a normal (resting) down position in which grippers 108 press a retained article 200 against vertical surface 202. It can be seen that attachment member 104 forms a fulcrum, while compressible member 106 when in an uncompressed state, pushes against the back side of plate 102 on one side of the fulcrum and forces grippers 108 on the opposite side of the fulcrum against the article.

FIG. 5 is another side view matching that of (FIG. 4); however, showing member 106 being compressed by a finger which pivots plate 102 and raises grippers 108 away from article 200.

FIG. 6 illustrates only one of many exemplary decorative aspects of the present invention.

While to mount a poster to a wall, four clamping plates 102 are typically required; one at each corner to prevent the poster from curling, the gripping strength of the clamping plates is sufficient such than a single plate can support the poster. Although the embodiments depicted herein show a plate suited for use at corners of sheet articles, the operative principle of the present invention can be applied to an elongated element such as a strip of wood, cardboard or plastic pressed against a top border of the sheet article.

In view of the many possible embodiments to which the principles of the disclosed invention may be applied, it should be recognized that the illustrated embodiments are only preferred examples of the invention and should not be taken as limiting the scope of the invention. Therefore, this disclosure is intended to cover such alternatives, modifications, and equivalents as may be included in the spirit and scope of the description in view of the appended drawings and claims.

I claim:

1. A surface attachable device for retaining a sheet article against a non-pivoting mounting surface, comprising:

(1) a pivotable portion with a front and back side without a fixed axis for pivoting, and;

(2) a flexible fulcrum having a first part thereof configured to adhesively adhere directly to the non-pivoting mounting surface, and a second part configured to project from the pivotable portion, and wherein the first and second parts of the fulcrum are reversibly separable from one another; and, (3) a resilient member when in an uncompressed state provides force to a portion of the pivotable portion biasing a portion of the pivotable portion against the supported sheet article and the non-pivoting mounting surface abutting the sheet article.

2. The device according to claim 1 further comprising at least one gripper for applying force against a portion of the sheet article.

3. The device according to claim 1 in which the non-pivoting mounting surface is separate from the device.

4. The device according to claim 1 in which the retained sheet article is loosed by pressing down on the front side of the pivotable portion and depressing the resilient member.

5. The device according to claim 1 wherein the fulcrum comprises a pair of hook and loop members or foam tape.

6. A method of retaining a sheet article to a non-pivoting vertical surface comprising the steps of:

(1) providing a pivotable plate without a fixed axis for pivoting, and having at least a front side and a back side wherein the back side has at least one compressible member, a flexible fulcrum, and at least one gripping member, (2) adhesively adhering a first portion of the fulcrum directly to a non-pivoting vertical surface, (3) adhering a second portion of the fulcrum to the first portion of the fulcrum wherein the plate is attached to the second portion, (4) pressing down on one end of the plate to raise the opposite end of the plate, (5) placing sheet stock under the raised end of the plate, and, (6) discontinuing to press the plate, permitting the compressible member to decompress and the at least one gripping member to bear down against the sheet article with sufficient pressure to retain the sheet article.

7. The method according to claim 6 wherein the vertical surface is separate from the fulcrum.

8. The method according to claim 6 wherein the fulcrum comprises foam tape or a hook and loop fastener pair.

* * * * *